US012765681B2

(12) United States Patent
Liu et al.

(10) Patent No.: US 12,765,681 B2
(45) Date of Patent: Oct. 20, 2026

(54) CONNECTOR ASSEMBLY FOR CONNECTING TOGETHER SECTIONS/SECTIONALS OF FURNITURE PIECES

(71) Applicant: MOTOMOTION CHINA CORPORATION, Changzhou (CN)

(72) Inventors: Chih Hsiung Liu, Benoni (ZA); Hai Guo Jiang, Changzhou (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 97 days.

(21) Appl. No.: 18/815,667

(22) Filed: Aug. 26, 2024

(65) Prior Publication Data

US 2026/0053272 A1 Feb. 26, 2026

(51) Int. Cl.

| | |
|---|---|
| ***A47C 13/00*** | (2006.01) |
| ***A47C 1/124*** | (2006.01) |
| ***A47C 15/00*** | (2006.01) |

(52) U.S. Cl.

CPC ..... *A47C 13/005* (2013.01); *A47C 1/124* (2013.01); *A47C 15/002* (2013.01)

(58) Field of Classification Search

CPC ..... A47C 13/005; A47C 1/124; A47C 15/002; F16B 12/06; F16B 2200/67

USPC ..... 297/233

See application file for complete search history.

(56) References Cited

U.S. PATENT DOCUMENTS

| | | | | | |
|---|---|---|---|---|---|
| 2,644,960 | A * | 7/1953 | Blanke | A47C 19/021 | 5/299 |
| 2,877,470 | A * | 3/1959 | Roth | F16B 12/60 | 5/285 |
| 2,968,051 | A * | 1/1961 | Imber | A47C 19/04 | 5/285 |
| 3,803,644 | A * | 4/1974 | Harris | A47C 19/04 | 5/200.1 |
| 4,007,502 | A * | 2/1977 | Mis | A47C 19/021 | 5/310 |

(Continued)

*Primary Examiner* — J. T. Newton

(74) *Attorney, Agent, or Firm* — LawOffices of Steven W. Weinrieb

(57) ABSTRACT

A connector assembly is adapted to be utilized in conjunction with a plurality of base frame members upon which furniture piece sectionals are to be fixedly attached. More particularly, the base frame members comprise a plurality of transversely extending cross-beam members having a predetermined cross-sectional configuration and comprising a male connector. A connecting mechanism, having a cross-sectional configuration which is similar to that of the transversely extending cross-beam members, serves as a female connector as a result of having a slot defined within each opposite end thereof, wherein each one of the slots has a geometrical configuration that matches the geometrical configurations of the male connector transversely extending cross-beam members. Accordingly, when the male connector portion of each one of the transversely extending cross-beam members is inserted into each opposite end of the female connecting mechanism, the two male connector transversely extending cross-beam base frame members will be connected together so that, together with the intervening connecting mechanism, different sectionals of the furniture piece sofa can be connected together in different ways so as to provide the resulting furniture piece sofa with different geometrical configurations.

18 Claims, 5 Drawing Sheets

(56) References Cited

U.S. PATENT DOCUMENTS

| | | | | | |
|---|---|---|---|---|---|
| 4,038,710 | A * | 8/1977 | Tambascio | A47C 19/04 | 5/310 |
| 4,754,506 | A * | 7/1988 | Yeh | F16B 12/30 | 403/205 |
| 5,231,713 | A * | 8/1993 | McDonnell | A47C 19/045 | 5/310 |
| 6,209,155 | B1 * | 4/2001 | Epstein | A47C 19/04 | 5/285 |
| 6,397,413 | B2 * | 6/2002 | Epstein | A47C 19/025 | 5/310 |
| 6,415,465 | B1 * | 7/2002 | Harrow | A47C 19/027 | 5/184 |
| 6,839,920 | B2 * | 1/2005 | Schulte | A47C 19/024 | 5/305 |
| 7,503,529 | B2 * | 3/2009 | Bartelsmeyer | A47C 19/027 | 248/354.3 |
| 7,690,058 | B1 * | 4/2010 | Dwyer | A47C 19/024 | 5/310 |
| 8,585,313 | B2 * | 11/2013 | Wojotowicz | A47B 87/0215 | 248/300 |
| 8,714,864 | B2 * | 5/2014 | Wojtowicz | A47F 5/14 | 403/109.8 |
| 8,869,323 | B2 * | 10/2014 | Chung | A47C 19/005 | 5/132 |
| 10,694,849 | B2 * | 6/2020 | Liss | F16B 12/32 | |
| 2007/0063112 | A1 * | 3/2007 | Patterson | F16B 12/46 | 297/440.1 |
| 2008/0155799 | A1 * | 7/2008 | Bartelsmeyer | A47C 19/027 | 24/457 |
| 2017/0273468 | A1 * | 9/2017 | Polevoy | A47C 19/12 | |

* cited by examiner

CONNECTOR ASSEMBLY FOR CONNECTING TOGETHER SECTIONS/SECTIONALS OF FURNITURE PIECES

FIELD OF THE INVENTION

The present invention relates generally to connecting mechanisms or connectors, more particularly to a connecting assembly for connecting furniture pieces together, and still more particularly to a new and improved connecting assembly for connecting sofa sections or sofa sectionals together in a side-by-side manner.

BACKGROUND OF THE INVENTION

Sofa furniture pieces are of course commonly present within homes or residences, and in accordance with current or modern interior design plans, the sofas often comprise sections or sectionals which may be connected together in various different ways so as to effectively create a sofa which may have any one of a plurality of different designs, shapes, configurations, or the like. For example, the finalized sofa may effectively have an L-shaped configuration. Alternatively, the finalized sofa may have a U-shaped configuration. In any case, the various different sections or sectionals must be connected together such that the finalized sofa effectively has an integral structure for safety and comfort reasons. It has been experienced, however, that current connectors, connecting mechanisms, or connecting assemblies are often difficult to operate, they may not be readily accessible, and/or they may require several people to manipulate and achieve the requisite connections.

A need therefore exists in the art for a new and improved connecting mechanism, connector, or assembly. Another need exists in the art for a new and improved connecting mechanism, connector, or assembly which can be readily utilized in connection with furniture pieces. Still another need exists in the art for a new and improved connecting mechanism, connector, or assembly which can be readily utilized in connection with furniture pieces, and more particularly, sofas. Yet another need exists in the art for a new and improved connecting mechanism, connector, or assembly which can be readily utilized in connection with furniture pieces, and more particularly, sofas, so as to effectively connect sofa sections or sectionals together. Yet still another need exists in the art for a new and improved connecting mechanism, connector, or assembly which can be readily utilized in connection with furniture pieces, and more particularly, sofas, so as to effectively connect sofa sections or sectionals together in order to form a particular finalized sofa. Still yet another need exists in the art for a new and improved connecting mechanism, connector, or assembly which can be readily utilized in connection with furniture pieces, and more particularly, sofas, so as to effectively connect sofa sections or sectionals together in order to form a particular finalized sofa having a particular or predetermined configuration.

A further need exists in the art for a new and improved connecting mechanism, connector, or assembly which can be readily utilized in connection with furniture pieces, and more particularly, sofas, so as to effectively connect sofa sections or sectionals together in order to form a particular finalized sofa having a particular or predetermined configuration, and wherein the new and improved connecting mechanism, connector, or assembly is easy to operate or manipulate in order to in fact connect the sofa sections or sectionals together. A still further need exists in the art for a new and improved connecting mechanism, connector, or assembly which can be readily utilized in connection with furniture pieces, and more particularly, sofas, so as to effectively connect sofa sections or sectionals together in order to form a particular finalized sofa having a particular or predetermined configuration, and wherein the new and improved connecting mechanism or connector is easy to operate or manipulate in order to in fact connect the sofa sections or sectionals together, whereby the finalized sofa effectively has an integral structure. A yet further need exists in the art for a new and improved connecting mechanism, connector, or assembly which can be readily utilized in connection with furniture pieces, and more particularly, sofas, so as to effectively connect sofa sections or sectionals together in order to form a particular finalized sofa having a particular or predetermined configuration, and wherein the new and improved connecting mechanism or connector is easy to operate or manipulate in order to in fact connect the sofa sections or sectionals together, whereby the finalized sofa effectively has an integral structure which will provide users with the requisite degree of safety and comfort.

OVERALL OBJECTIVES OF THE INVENTION

Accordingly, an overall objective of the present invention is to provide a new and improved connecting mechanism, connector, or assembly. Another overall objective of the present invention is to provide a new and improved connecting mechanism, connector, or assembly which can be readily utilized in connection with furniture pieces. Still another overall objective of the present invention is to provide a new and improved connecting mechanism, connector, or assembly which can be readily utilized in connection with furniture pieces, and more particularly, sofas. Yet another overall objective of the present invention is to provide a new and improved connecting mechanism, connector, or assembly which can be readily utilized in connection with furniture pieces, and more particularly, sofas, so as to effectively connect sofa sections or sectionals together. Yet still another overall objective of the present invention is to provide a new and improved connecting mechanism, connector, or assembly which can be readily utilized in connection with furniture pieces, and more particularly, sofas, so as to effectively connect sofa sections or sectionals together in order to form a particular finalized sofa. Still yet another overall objective of the present invention is to provide a new and improved connecting mechanism, connector, or assembly which can be readily utilized in connection with furniture pieces, and more particularly, sofas, so as to effectively connect sofa sections or sectionals together in order to form a particular finalized sofa having a particular or predetermined configuration.

A further overall objective of the present invention is to provide a new and improved connecting mechanism, connector, or assembly which can be readily utilized in connection with furniture pieces, and more particularly, sofas, so as to effectively connect sofa sections or sectionals together in order to form a particular finalized sofa having a particular or predetermined configuration, and wherein the new and improved connecting mechanism, connector, or assembly is easy to operate or manipulate in order to in fact connect the sofa sections or sectionals together. A still further overall objective of the present invention is to provide a new and improved connecting mechanism, connector, or assembly which can be readily utilized in connection with furniture pieces, and more particularly, sofas, so as to effectively connect sofa sections or sectionals together in order to form a particular finalized sofa having a particular or predetermined configuration, and wherein the new and improved connecting mechanism, connector, or assembly is easy to operate or manipulate in order to in fact connect the sofa sections or sectionals together, whereby the finalized sofa effectively has an integral structure. A yet further overall objective of the present invention is to provide a new and improved connecting mechanism, connector, or assembly which can be readily utilized in connection with furniture pieces, and more particularly, sofas, so as to effectively connect sofa sections or sectionals together in order to form a particular finalized sofa having a particular or predetermined configuration, and wherein the new and improved connecting mechanism, connector, or assembly is easy to operate or manipulate in order to in fact connect the sofa sections or sectionals together, whereby the finalized sofa effectively has an integral structure which will provide users with the requisite degree of safety and comfort.

SUMMARY OF THE INVENTION

The foregoing and other objectives are achieved, in accordance with the principles and teachings of the present invention, by means of a first embodiment of a new and improved connector, connecting mechanism, or assembly which is adapted to be utilized in conjunction with a plurality of base frame members upon which, or to which, the furniture piece sofa sections or sectionals are to be fixedly attached. More particularly, the base frame members comprise a plurality of transversely extending cross-beam members wherein each one of the plurality of transversely extending cross-beam members has a predetermined cross-sectional configuration and effectively comprises a male connector. In addition, a connector or connecting mechanism, effectively having a cross-sectional configuration which is similar to or matching that of each one of the transversely extending cross-beam members, effectively serves as a female connector as a result of having a slot defined within each opposite end thereof and wherein each one of the slots has a geometrical configuration that matches the geometrical configurations of the male connector transversely extending cross-beam members. Accordingly, once the male connector portion of each one of the transversely extending cross-beam members is inserted into each opposite end of the female connector or connecting mechanism, the two male connector, transversely extending, cross-beam base frame members will be connected together so that, together with the intervening connector or connecting mechanism, different sections or sectionals of the furniture piece sofa can be connected together in different ways so as to provide the resulting furniture piece sofa with different geometrical configurations, such as, for example, an L-shaped configuration, a U-shaped configuration, or any other configuration which may be desired in accordance with a particularly desired interior design plan.

In accordance with a second embodiment of the present invention, a connector, having a substantially L-shaped cross-sectional configuration and serving as a male connector, is adapted to be fixedly secured atop one of the cross-beam frame members at one end thereof, while the second opposite end thereof is adapted to be inserted into the L-shaped slot of the female connector or connecting mechanism. Still further, in accordance with a third embodiment of the present invention, a connector, also having a substantially L-shaped cross-sectional configuration and serving as a male connector, is adapted to be fixedly secured to a sidewall portion of a furniture piece at one end thereof, while the second opposite end thereof is adapted to be inserted into the L-shaped slot of the female connector or connecting mechanism.

BRIEF DESCRIPTIONS OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 1 is a front, right side perspective view of a first embodiment of a structural system comprising a plurality of base frame members of a furniture piece, wherein the base frame members comprise a pair of transversely extending cross-beam male connectors, and a female connector or connecting mechanism, into opposite sides of which the pair of transversely extending cross-beam male connectors are adapted to be inserted so as to provide an underlying base frame for at least two furniture piece sofa sections or sectionals to be fixedly connected together;

FIG. 2 is a front, right side perspective view of a pair of furniture piece sofa sections or sectionals that have been fixedly connected together as a result of being connected to, or mounted upon, the underlying base frame, by means of the new and improved connecting assembly, comprising the pair of transversely extending cross-beam male connectors and the intervening female connector or connecting mechanism, as illustrated within FIG. 1;

Figure 6:
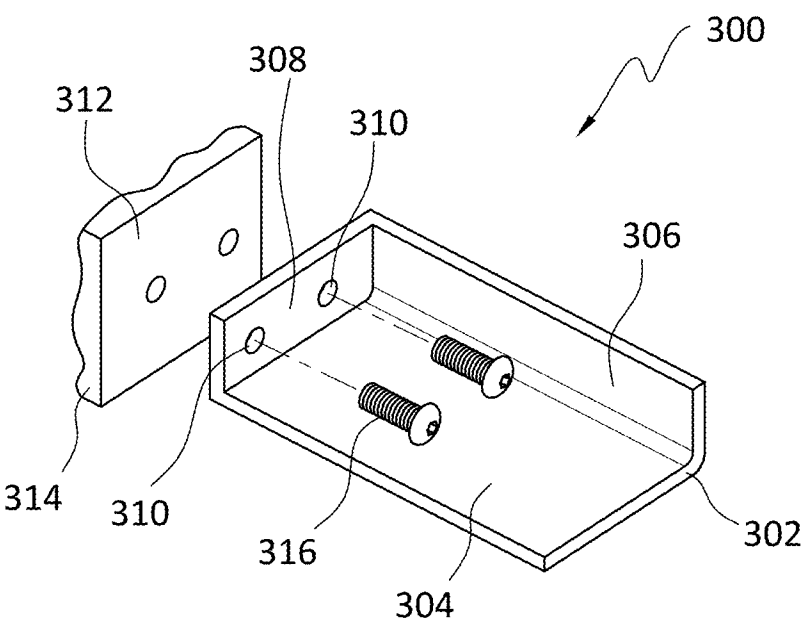
Figure 5:
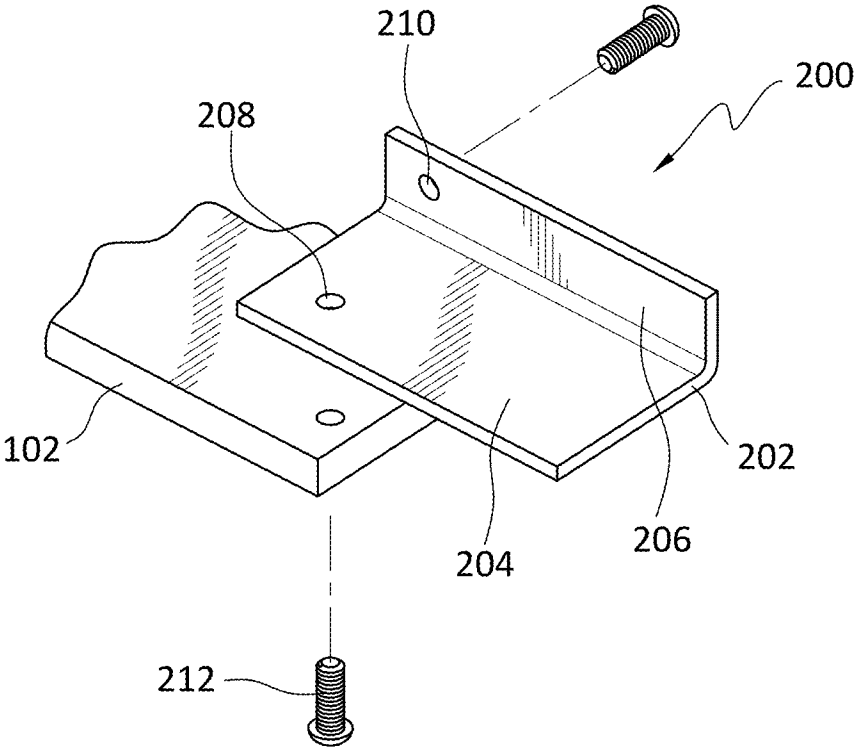

FIG. 5 is a right side, top perspective view of a second embodiment of a new and improved connector, having a substantially L-shaped cross-sectional configuration and serving as a male connector which is adapted to be fixedly secured atop one of the cross-beam frame members at one end thereof, or alternatively to a cross-beam member, while the second opposite end thereof is adapted to be inserted into the L-shaped slot of the female connector or connecting mechanism; and FIG. 6 is a right side, top perspective view of a third embodiment of a new and improved connector, also having a substantially L-shaped cross-sectional configuration and serving as a male connector which is adapted to be fixedly secured to a sidewall portion of a furniture piece at one end thereof, while the second opposite end thereof is adapted to be inserted into the L-shaped slot of the female connector or connecting mechanism.

DETAILED DESCRIPTION OF THE PREFERRED EMBODIMENT

Figure 1:
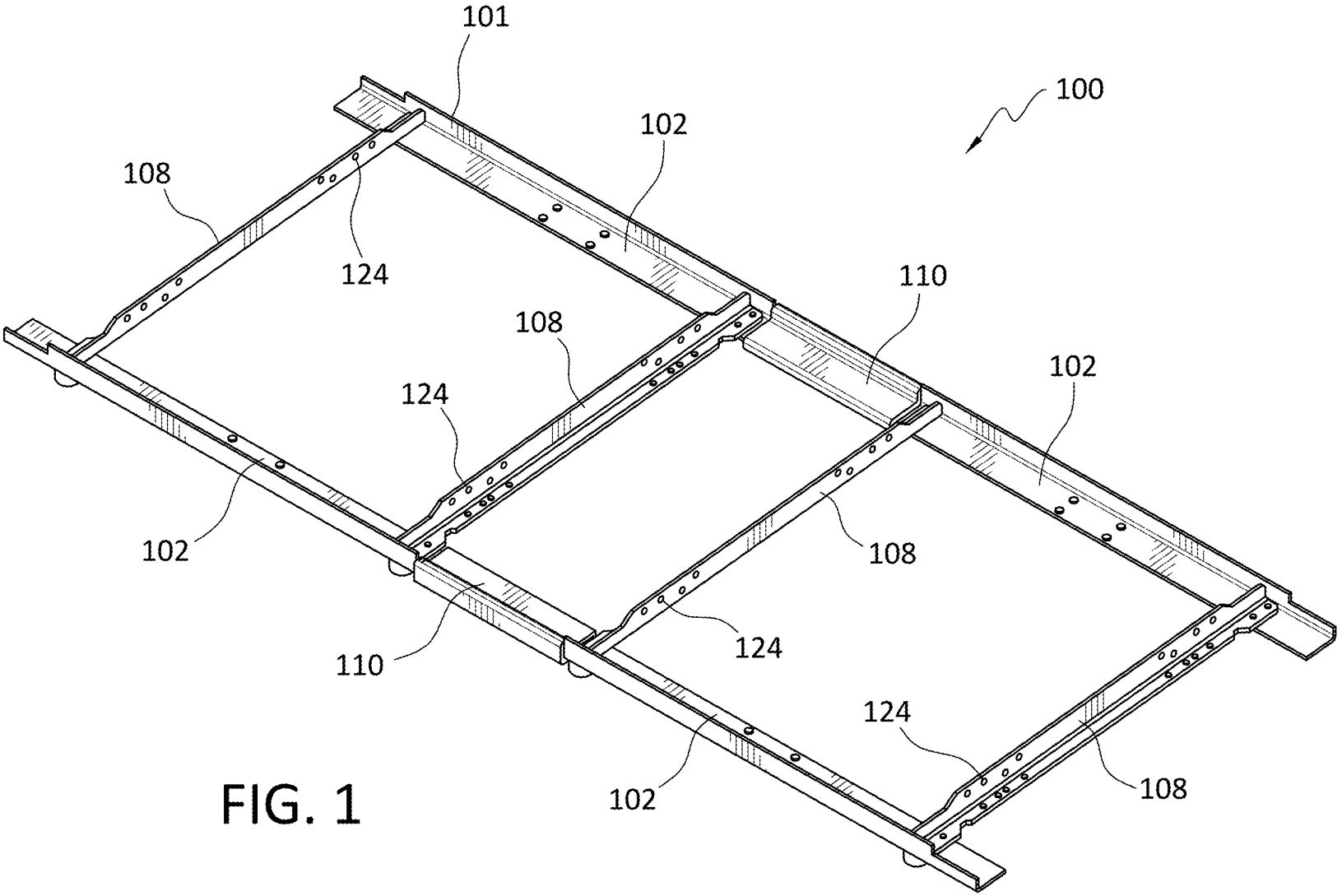
Figure 3:
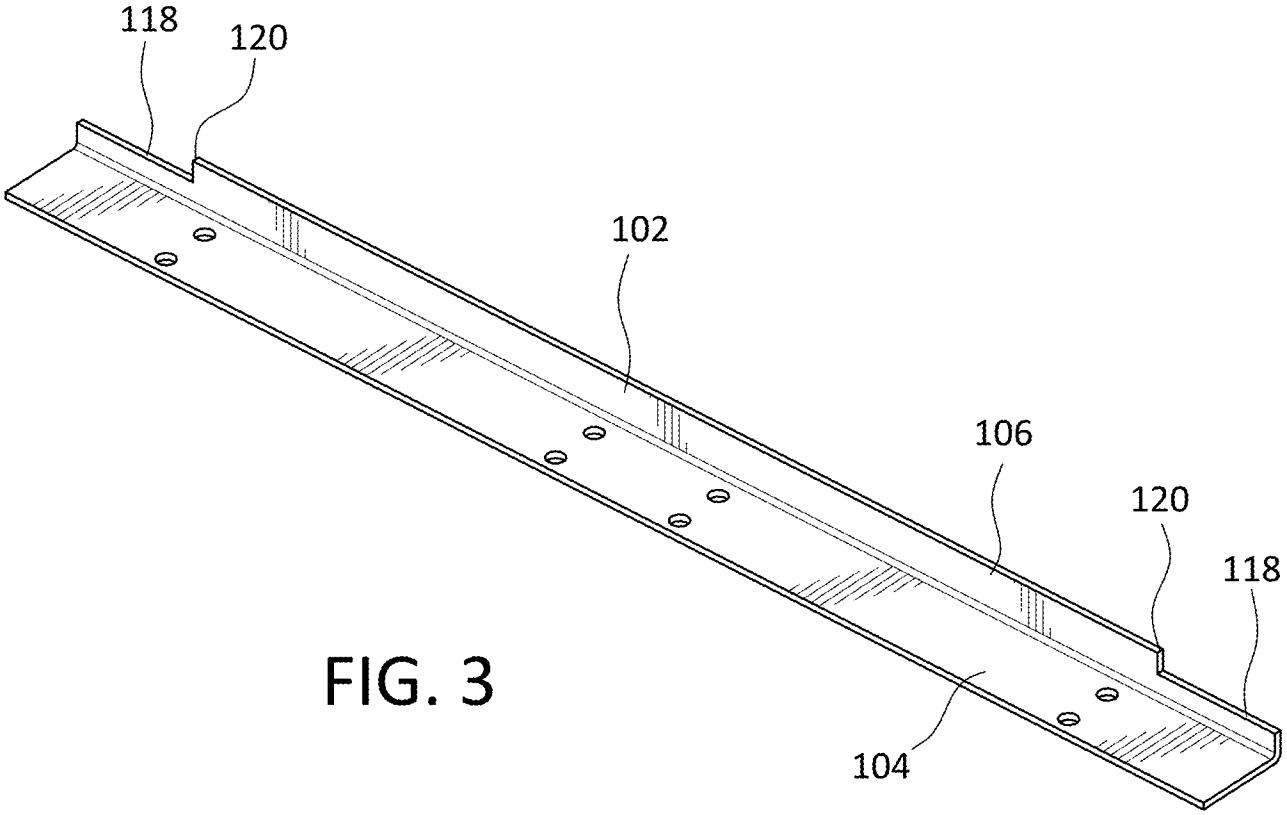
FIG. 3 is a front, right side perspective view of one of the transversely extending cross-beam male connectors comprising part of the new and improved connecting assembly which is utilized to effectively form the underlying base frame as illustrated within FIG. 1.
Figure 4:
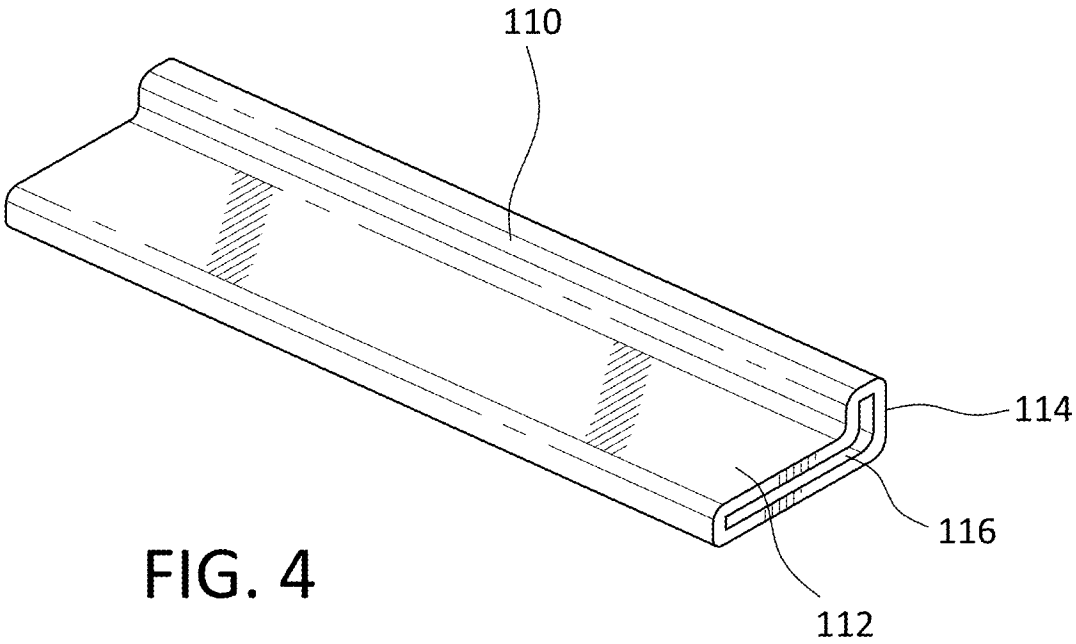
FIG. 4 is a front, right side perspective view of one of the female connectors or connecting mechanisms comprising part of the new and improved connecting assembly which is utilized to effectively form the underlying base frame as illustrated within FIG. 1.

Referring now to the drawings, and more particularly to FIGS. 1, 3, and 4 thereof, a first embodiment of a new and improved connector, connecting mechanism, or connector assembly, which is adapted to be utilized in conjunction with a plurality of base frame members upon which, or to which, furniture piece sofa sections or sectionals are to be fixedly attached, is disclosed and is generally indicated by the reference character 100. More particularly, it is seen that the first embodiment of the new and improved connector or connecting mechanism assembly 100 comprises an underlying base frame structure 101 which comprises a plurality of first transversely extending cross-beam members 102 which are longitudinally spaced with respect to each other so as to be disposed opposite, and parallel, to each other, wherein each one of the plurality of first transversely extending cross-beam members 102 has a predetermined cross-sectional configuration, as can best be seen in FIG. 3, and wherein each one of the plurality of first transversely extending cross-beam members 102 effectively comprises a male connector. Still more particularly, it can be appreciated that each one of the plurality of first transversely extending cross-beam members 102 has a substantially L-shaped cross-sectional configuration comprising a horizontally extending leg member 104 and a vertically extending leg member 106. In addition, the underlying base frame structure 101 also comprises a plurality of second longitudinally extending cross-beam members 108 which are transversely spaced with respect to each other so as to be disposed parallel to each other, and wherein each one of the second longitudinally extending cross-beam members 108 is fixedly connected at their opposite end portions to the plurality of first transversely extending cross-beam members 102 so as to complete the base frame structure 101 which effectively has a substantially rectangular configuration. Still yet further, it is seen that the overall base frame structure 101 also effectively comprises a plurality of oppositely disposed connectors or connecting mechanisms 110 as a result of the plurality of oppositely disposed connectors or connecting mechanisms 110 being structurally mated, at oppositely disposed ends thereof, with a plurality of the first transversely extending cross-beam members 102, as will be more fully described hereinafter.

More particularly as can best be appreciated from FIG. 4, each one of the plurality of oppositely disposed connectors or connecting mechanisms 110 has a cross-sectional configuration which is similar to or matching that of each one of the first transversely extending cross-beam members, effectively serves as a female connector as a result of having a slot defined within each opposite end thereof, and wherein each one of the slots has a geometrical configuration that matches the geometrical configurations of each one of the plurality of male connector transversely extending cross-beam members 102. More specifically, it can be appreciated that each one of the plurality of oppositely disposed connectors or connecting mechanisms 110 has a substantially L-shaped cross-sectional configuration comprising a horizontally extending leg member 112 and a vertically extending leg member 114. Still further, it is additionally seen that each opposite end of each one of the plurality of oppositely disposed connectors or connecting mechanisms 110 is provided with, or has defined therein, a slot 116 which likewise has a substantially L-shaped cross-sectional configuration.

Figure 2:
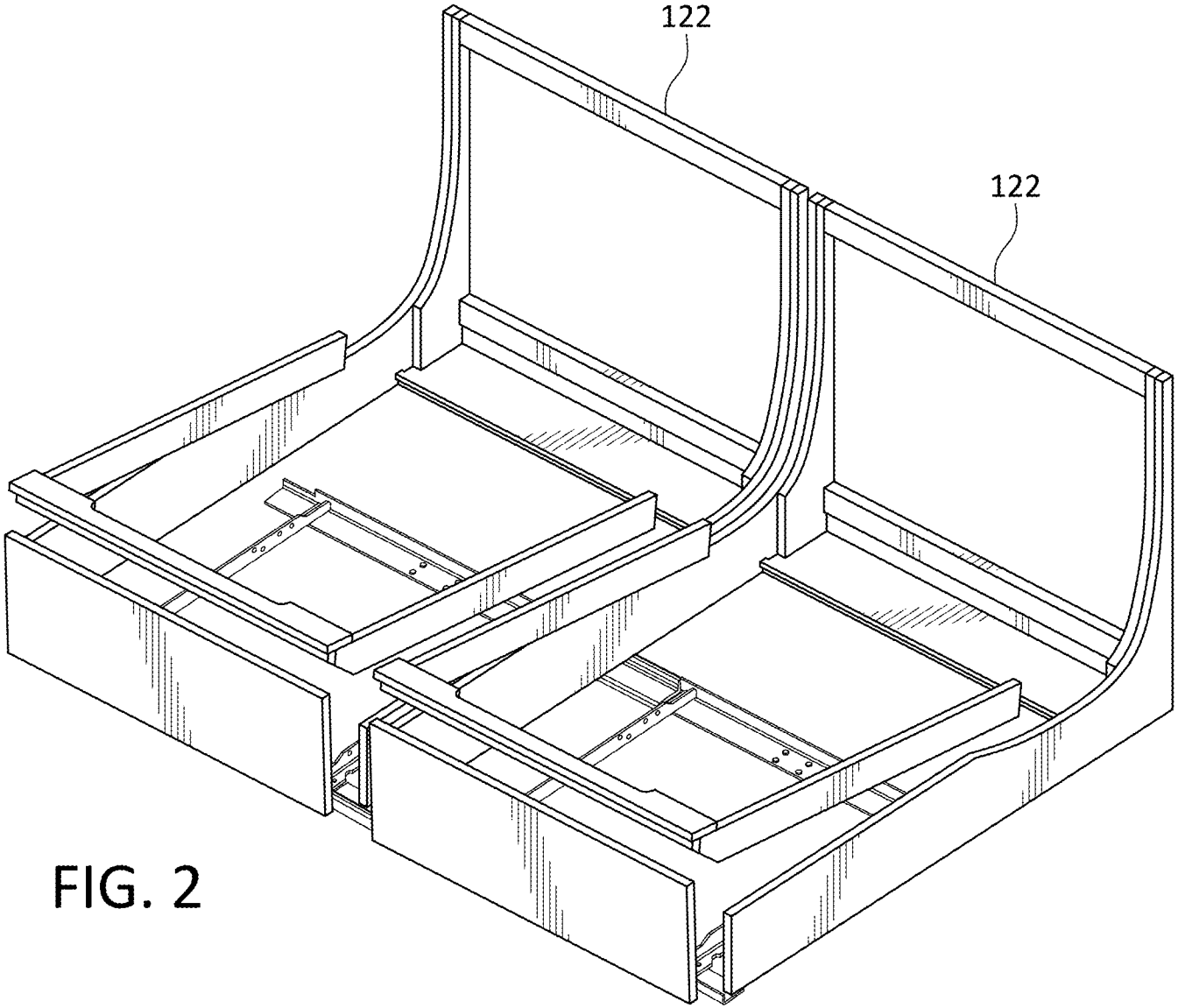

Still yet further, as can best be appreciated from FIG. 3, oppositely disposed end portions of each one of the upstanding leg portions 106 of each one of the plurality of first transversely extending cross-beam members 102 is provided with a cut-out portion 118 which therefore effectively defines an upstanding limit stop member 120. Accordingly, when the male connector portion of each one of the plurality of first transversely extending cross-beam members 102 is inserted into the slot 116 defined within each opposite end of each female connector or connecting mechanism 110, the upstanding limit stop members 120 of the cut-out portions 118 of the plurality of the first transversely extending cross-beam members 102 will engage or abut external surface portions of the vertically extending leg members 114, defined upon the oppositely disposed end portions of the connectors or connecting mechanisms 110. In this manner, the two first transversely extending cross-beam members 102 of the base frame 101 will be connected together so that, together with the intervening connectors or connecting mechanisms 110, different sections or sectionals 122 of the furniture piece sofa can be connected together, as illustrated within FIG. 2, in different ways so as to provide the resulting furniture piece sofa with different geometrical configurations, such as, for example, an L-shaped configuration, a U-shaped configuration, or any other configuration which may be desired in accordance with a particularly desired interior design plan. It is lastly noted that the different sections or sectionals 122 of the furniture piece sofa are fixedly connected to the second longitudinally extending cross-beam members 108 of the underlying base frame structure 101 by means of suitable fasteners which are schematically illustrated at 124 in FIG. 1.

Referring now to FIG. 5, a second embodiment of a new and improved connector, having a substantially L-shaped cross-sectional configuration and serving as a male connector which is adapted to be fixedly secured atop each one of the cross-beam frame members at one end thereof while the second opposite end thereof is adapted to be inserted into the L-shaped slot of the female connector or connecting mechanism, is disclosed and is generally indicated by the reference character 200. More particularly, this male connector 200 is seen to comprise a body portion 202 which has a substantially L-shaped cross-sectional configuration and comprises a horizontally extending portion 204 and a vertically extending portion 206 integrally connected to the horizontally extending portion 204. Furthermore, it is seen that one end of the body portion 202 has a first aperture 208 defined within the horizontally extending portion 204, while a second aperture 210 is defined within the vertically extending portion 206. Accordingly, one means of utilizing the male connector 200 would be to fixedly attach the male connector 200 atop one end of each one of the cross-beam frame members 102 by fixedly securing the left end portion of the male connector 200 to each one of the cross-beam frame members 102 by means of a screw fastener or the like 212 which is adapted to be inserted through an end portion of the cross-beam frame member 102 and the first aperture 208 defined within the horizontally extending portion 204 of the male connector 200. In a similar manner, the male connector 200 can be fixedly attached to one end of each one of the cross-beam frame members 102 by fixedly securing the left end portion of the male connector 200 to each one of the vertically extending leg members 106 of the cross-beam frame members 102 by means of a screw fastener or the like 212 which is adapted to be inserted through the second aperture 210 defined within the vertically extending portion 206 of the male connector 200 and into the vertically extending leg member 106 of the cross-beam frame member 102 whereby the pair of cross-beam members 102 would be coplanar. In this case, it is to be noted that the cut-out portion 118 of the cross-beam member 102 would be eliminated. The right side of the male connector 200 is adapted to be inserted into the L-shaped slot 116 defined within the female connector or connecting mechanism 110 preferably before the fixation of the male connector 200 to the underlying or coplanar cross-beam member 102. Concomitantly, a similar, mirror image second connector 200 will have its right side adapted to be fixedly connected to a second cross-beam member 102 while the left side of the second connector 200 will be inserted into the L-shaped slot 116 defined within the female connector or connecting mechanism 110, preferably before the fixation of the male connector 200 to the underlying or coplanar cross-beam member 102.

With reference lastly being made to FIG. 6, a third embodiment of a new and improved connector, also having a substantially L-shaped cross-sectional configuration and serving as a male connector which is adapted to be fixedly secured to a sidewall portion of a furniture piece at one end thereof, while the second opposite end thereof is adapted to be inserted into the L-shaped slot of the female connector or connecting mechanism, is disclosed and is generally indicated by the reference character 300. More particularly, this male connector 300 is seen to comprise a body portion 302 which has a substantially L-shaped cross-sectional configuration and comprises a horizontally extending portion 304 and a vertically extending portion 306 integrally connected to the horizontally extending portion 304. In addition, it is seen that the body portion 302 also comprises a vertical end wall portion 308, and that the vertical end wall portion 308 has a pair of apertures 310 defined therein. Accordingly, one means of utilizing the male connector 300 would be to fixedly attach the male connector 300 to a side wall 312 of a first furniture piece 314 by fixedly securing the left end portion of the male connector 300 to the side wall 312 of the first furniture piece 314 by means of screw fasteners or the like 316 which are adapted to be inserted through the apertures 310 defined within the vertical end wall portion 308 of the connector 300 whereby the screw fasteners 316 can then be inserted into the side wall 312 of the first furniture piece 314. The right side of the male connector 300 is adapted to be inserted into the L-shaped slot 116 defined within the female connector or connecting mechanism 110 prior to the attachment of the male connector 300 to the side wall 312 of the first furniture piece 314. Concomitantly, a similar, mirror image second connector 300 will have its right side adapted to be fixedly connected to a second furniture piece 314 while the left side of the second connector 300 will be inserted into the L-shaped slot 116 defined within the female connector or connecting mechanism 110 prior to the attachment of the second male connector 300 to the second furniture piece 314. It is to be noted that in accordance with this third embodiment of the invention, the first and second furniture pieces 314 will be attached to the plurality of first transversely extending cross-beam members 102 and the plurality of second longitudinally extending cross-beam members 108 of the underlying base frame structure 101, and subsequently, the first and second furniture pieces 314,314 can be connected to each other by means of the two male connectors 300,300 and the female connector or connecting mechanism 110.

Obviously, many variations and modifications of the present invention are possible in light of the above teachings. It is therefore to be understood that within the scope of the appended claims, the present invention may be practiced otherwise than as specifically described herein.

What is claimed, and desired to be protected by Letters Patent, is:

1. A connector assembly for connecting together furniture-piece sections, comprising:

an underlying base frame structure to which at least one pair of furniture-piece sections can be fixedly connected;

said underlying base frame structure comprising a linear array of at least one pair of longitudinally extending male connectors, and a longitudinally extending female connector interposed between said at least one pair of longitudinally extending male connectors such that a first end of each one of said at least one pair of longitudinally extending male connectors is inserted into an opposite end of said longitudinally extending female connector member such that said at least one pair of longitudinally extending male connectors are fixedly connected to said longitudinally extending female connector interposed between said at least one pair of male connectors whereby said at least one pair of longitudinally extending male connectors and said longitudinally extending female connector define said linear array of said underlying base frame structure; and whereby said at least one pair of furniture-piece sections are fixedly connected together as a result of being fixedly connected to said underlying base frame structure.

2. The connector assembly as set forth in claim 1, wherein:

each one of said at least one pair of male connectors comprises a first transversely extending cross-beam member of said underlying base frame structure.

3. The connector assembly as set forth in claim 2, wherein:

said underlying base frame structure comprises at least one additional pair of longitudinally extending male connectors and an additional longitudinally extending female connector interposed between said at least one additional pair of longitudinally extending male connectors so as to define a second transversely extending cross-beam member.

4. The connector assembly as set forth in claim 3, wherein:

said at least one pair of first transversely extending cross-beam members comprises a pair of oppositely disposed first transversely extending cross-beam members, and said at least one pair of second longitudinally extending cross-beam members comprises a pair of oppositely disposed second longitudinally extending cross-beam members, wherein said pair of oppositely disposed first transversely extending cross-beam members and said pair of oppositely disposed second longitudinally extending cross-beam members are fixedly connected together at end portions thereof so as to define said underlying base frame structure.

5. The connector assembly as set forth in claim 4, wherein:

said underlying base frame structure has a substantially rectangular configuration.

6. The connector assembly as set forth in claim 5, wherein:

said underlying base frame structure, having said substantially rectangular configuration, comprises a pair of side-by-side underlying rectangular base frame structures whereby said at least one pair of furniture-piece sections can be fixedly connected together as a result of being fixedly connected to said pair of side-by-side underlying base frame structures.

7. The connector assembly as set forth in claim 1, wherein:

each one of said at least one pair of male connector members, and said female connector member, has a substantially L-shaped cross-sectional configuration.

8. The connector assembly as set forth in claim 7, wherein:

said female connector member, having said substantially L-shaped cross-sectional configuration, has a slot, defined within each end of said female connector member, for accommodating each one of said at least one pair of male connector members.

9. The connector assembly as set forth in claim 8, wherein:

each one of said slots, defined within each end of said female connector member, has a substantially L-shaped cross-sectional configuration for accommodating each one of said at least one pair of male connector members.

10. The connector assembly as set forth in claim 8, wherein:

opposite ends of each one of said at least one pair of male connector members have a limit stop member integrally defined thereon for engaging an external surface portion of said female connector member as each one of said at least one pair of male connector members is inserted into an end of said female connector member.

11. A connector assembly for connecting together furniture-piece sections, comprising:

an underlying base frame structure to which at least one pair of furniture-piece sections can be fixedly connected;

said underlying base frame structure comprising at least one pair of cross-beam members, and a female connector interposed between said at least one pair of cross-beam members; and a pair of male connectors having first ends adapted to be fixedly secured to end portions of said at least one pair of cross-beam members, and having second ends adapted to be inserted into opposite ends of said female connector, such that said at least one pair of cross-beam members are fixedly connected to said female connector as a result of said pair of male connectors, having said first ends fixedly secured to said end portions of said at least one pair of cross-beam members, also having said second ends disposed within said opposite ends of said female connector which is interposed between said at least one pair of cross-beam members such that said at least one pair of cross-beam members are separated from each other by said female connector;

whereby said at least one pair of furniture-piece sections are fixedly connected together as a result of being fixedly connected to said underlying base frame structure.

12. The connector assembly as set forth in claim 11, wherein:

said at least one pair of cross-beam members, said female connector member, and said pair of male connectors all have substantially L-shaped cross-sectional configurations.

13. The connector assembly as set forth in claim 12, wherein:

said female connector member, having said substantially L-shaped cross-sectional configuration, has a slot, defined within each end of said female connector member, for accommodating said pair of male connectors.

14. The connector assembly as set forth in claim 13, wherein:

each slot, defined within each end of said female connector member, has a substantially L-shaped cross-sectional configuration for accommodating said pair of male connectors.

15. A connector assembly for connecting together furniture-piece sections, comprising:

an underlying base frame structure to which at least one pair of furniture-piece sections can be fixedly connected;

said underlying base frame structure comprising at least one cross-beam member and at least one longitudinal beam member;

a male connector adapted to be fixedly secured to a side wall portion of each one of said at least one pair of furniture-piece sections; and a female connector being interposed between said male connectors fixedly secured to said side wall portions of said at least one pair of furniture-piece sections such that a first end of a first one of said male connectors can be inserted into a first end of said female connector, while a first end of a second one of said male connectors can be inserted into a second end of said female connector, and wherein second opposite ends of said first and second male connectors are fixedly secured to said side wall portions of said at least one pair of furniture-piece sections whereby said at least one pair of furniture-piece sections are adapted to be fixedly connected together as a result of said first and second male connectors being fixedly connected to said female connector which is interposed between said male connectors such that said male connectors are separated from each other by said female connector.

16. The connector assembly as set forth in claim 15, wherein:

said first and second male connectors and said female connector all have substantially L-shaped cross-sectional configurations.

17. The connector assembly as set forth in claim 16, wherein:

said female connector, having said substantially L-shaped cross-sectional configuration, has a slot, defined within each end of said female connector member, for accommodating each one of said male connectors.

18. The connector assembly as set forth in claim 17, wherein:

each one of said slots, defined within each end of said female connector, has a substantially L-shaped cross-sectional configuration for accommodating each one of said male connectors.

* * * * *